US006661322B1

(12) United States Patent
Anger

(10) Patent No.: US 6,661,322 B1
(45) Date of Patent: Dec. 9, 2003

(54) SOUND-INSULATING DEVICE FOR AN INDUCTION MACHINE

(75) Inventor: Jan Anger, Ludvika (SE)

(73) Assignee: ABB T & D Technology Ltd., Zurich (CH)

( * ) Notice: Subject to any disclaimer, the term of this patent is extended or adjusted under 35 U.S.C. 154(b) by 61 days.

(21) Appl. No.: 09/926,837

(22) PCT Filed: Jun. 28, 2000

(86) PCT No.: PCT/SE00/01362

§ 371 (c)(1),
(2), (4) Date: Mar. 22, 2002

(87) PCT Pub. No.: WO01/01425

PCT Pub. Date: Jan. 4, 2001

(30) Foreign Application Priority Data

Jun. 28, 1999 (SE) ..... 9902429

(51) Int. Cl.[7] ..... H01F 27/10

(52) U.S. Cl. ..... 336/57; 336/58; 336/94; 336/90

(58) Field of Search ..... 336/100, 90, 94, 336/57, 58; 181/294, 202, 208; 123/195 C

(56) References Cited

U.S. PATENT DOCUMENTS 4,228,869 A 10/1980 Bschorr
4,558,296 A 12/1985 Thoren
5,606,833 A * 3/1997 Andersson ..... 52/506.01
5,881,990 A * 3/1999 Kawamura ..... 248/638
6,401,518 B1 * 6/2002 OaKeeffe et al. ..... 73/19.01
6,424,246 B1 * 7/2002 Kysely et al. ..... 336/90

* cited by examiner

*Primary Examiner*—Anh Mai
(74) *Attorney, Agent, or Firm*—Oblon, Spivak, McClelland, Maier & Neustadt, P.C.

(57) ABSTRACT

A sound-insulating device for a stationary induction machine with an active part, an insulating fluid surrounding the active part, and a tank enclosing the insulating fluid. The sound-absorbing device includes a gas-filled cavity and a resilient member surrounding the gas-filled cavity, thus obtaining a sound-insulating device that is extremely compressible. In the induction machine, the device is arranged between the active part and the tank of the induction machine and is spaced from the inside of the tank. The sound-insulating device preferably has an extent in one plane, whereby the device has a membrane portion facing the active part and a membrane portion facing the tank. Preferably, at least one of the membrane portions has at least one corrugated region, and a spacing membrane is arranged in the cavity making contact with the membrane portion at at least two points.

20 Claims, 4 Drawing Sheets

SOUND-INSULATING DEVICE FOR AN INDUCTION MACHINE

TECHNICAL FIELD

The present invention relates to a sound-insulating device of the kind described in the preamble to the independent claim 1. The invention also relates to a liquid-insulated induction machine of the kind described in the preamble to the independent claim 14.

In this patent application, induction machine means a stationary induction machine,. that is, a transformer or an inductor. More particularly, the invention relates to a transformer. or an inductor-for voltage exceeding 1 kilovolt for a distribution or a transmission network.

BACKGROUND ART

A liquid-insulated induction machine comprises a tank, filled with insulating fluid, in which an active part is placed. In this connection, active part means an iron core and a winding subassembly. Due to electromagnetic forces, the active part oscillates during operation. These oscillations propagate in the insulating fluid to the roof, bottom and wall portions of the tank, which portions, outside the tank, generate an audible sound which may attain such sound intensities that it constitutes a problem. This is. particularly the case for induction machines placed in densely populated areas.

It is known to reduce the above-mentioned sound by placing, between the active part and the tank, a sound-insulating device comprising a gas-filled cavity, for the purpose of preventing oscillations in the insulating fluid from reaching the floor, bottom or wall portions of the tank. However, known sound-insulating devices have a limited compressibility, which has proved to suppress the sound-damping effect.

U.S. Pat. No. 1,846,887 describes a sound-insulating device of the type described above, in which a hollow, gas-filled double wall with rigid spacing blocks is placed between the active part of a transformer and the tank thereof. The task of the double wall is to absorb oscillations generated by the active part and to prevent these oscillations from reaching the tank. However, the rigid spacing blocks limit the compressibility of the double wall and convey the oscillations from one side of the double wall to the other side thereof, whereby the oscillations easily pass through the double wall.

Another sound-damping device of the type described above is described in U.S. Pat. No. 4,558,296 in the form of a sound-damping plate which is attached to the inside of a transformer tank. The plate has a front wall, a side wall and a rear wall which define a gas-filled cavity. The front wall has a frame-shaped edge portion, extending along the major part of its circumference, the average wall thickness of the edge portion being considerably smaller than the average total wall thickness of the front wall. Admittedly, by the relatively thin edge portion, the plate exhibits a limited compressibility, but the rigid mid-portion of the front wall reduces the same and suppresses the sound-damping ability of the plate. In addition, the location of the plate directly on the inside of the tank causes vibrations to be easily transmitted from the plate to the tank.

SUMMARY OF THE INVENTION

The object of the invention, from a first aspect of the invention, is to achieve a new type of sound-insulating device which is extremely compressible and which, at the same time, is simple in its construction, easy to manufacture and durable. This is achieved-according to the invention by a sound-insulating device according to the features described in the characterizing portion of the independent claim 1.

The object of the invention, from a second aspect of the invention, is to achieve an efficiently sound-damped stationary induction machine. This is achieved according to the invention by an induction machine according to the features described in the characterizing portion of the independent claim 14.

Advantageous embodiments are described in the characterizing portions of the dependent claims.

Experiments have shown that, in an induction machine with an active part, an insulating fluid surrounding the active part, and a tank enclosing the insulating fluid, an efficient sound insulation may be achieved by a sound-insulating device which, in contrast to known sound-insulating devices, is extremely compressible and resilient to all sound-generating oscillations occurring in the fluid, which sound-insulating device is placed between the active part and the tank, and spaced from the inside of the tank. The present invention aims to provide such a device.

The sound-insulating device according to the invention comprises a gas-filled cavity and a resilient membrane surrounding the cavity. The task of the membrane is to give the cavity a desired shape, to keep the cavity at the desired location in the induction machine, and to prevent the gas in the cavity from mixing with the insulating fluid. Within the frameworks which these tasks mechanically impose on the membrane, the membrane shall be as resilient as possible. In this context, it is very important for the gas not to leak out into the insulating fluid, since the insulating effect of the fluid in that case would be greatly deteriorated, which may result in damage to the induction machine.

The sound-insulating device preferably has an extent in one plane. In an induction machine, the sound-insulating device is arranged such that this plane substantially forms a right angle with the direction of propagation of the oscillations. The sound-insulated device thus has a first membrane portion which substantially faces the active part and a second membrane portion which is arranged in parallel with the first membrane portion and which substantially faces the inside of the tank.

In its simplest and most resilient embodiment, the membrane consists of rubber or some other polymer material. An induction machine may, however, have a service life of more than 30 years. Therefore, from the point of view of strength, a membrane of thin sheet metal is preferable to a polymer membrane since the sound-insulating device must operate during the whole life of the induction machine without the gas in the cavity leaking out. According to a preferred embodiment, the membrane is made from thin, stainless sheet steel, preferably of uniform thickness. From such a sheet, a membrane may be manufactured in a simple and rational way, which membrane is very resilient but which at the same time makes it possible to form the sound-insulating device into the desired shape. Preferably, the sound-insulating device is made from two thin sheets which are pressed and which, along their edges, are-gas-tightly attached to each other so as to surround the above-mentioned cavity. The sheets thereby form two membrane halves with an intermediate gas volume.

A sound-insulating device mounted in an induction machine, filled with insulating fluid, is influenced by the atmospheric pressure plus the hydrostatic pressure of the fluid, which gives an absolute pressure of about 100–200 kPa, depending on whether the sound-insulating device is placed at a high or a low level in the tank of the induction machine. The sound-insulating device must be able to withstand this pressure without the membrane being. compressed to such an extent that opposite membrane portions are brought into rigid contact with one another, in which case the sound-insulating ability of the device would be greatly deteriorated.

According to one embodiment of the sound-insulating device, the pressure in the cavity is equal to or higher than the absolute pressure of the insulating fluid. However, a high pressure in the cavity suppresses the sound-insulating compressibility of the device, and preferably the pressure in the cavity shall be as low as possible without the opposite membrane portions being brought into rigid contact with one another.

According to another embodiment of the sound-insulating device, the pressure in the cavity is lower than the absolute pressure of the insulating fluid, and a resilient spacing member is arranged in the cavity-making contact with the membrane at at least two points. The spacing member prevents rigid contact between opposite membrane portions, whereby a low pressure may be allowed in the cavity.

According to a further embodiment of the sound-insulating device, at least one region of the membrane is folded or corrugated, whereby a membrane is obtained which withstands the pressure from the insulating fluid but which, at the same time, is resilient to oscillations in the fluid. In a membrane of thin sheet, folding may be easily achieved by pressing the sheet when manufacturing the sound-insulating device.

To obtain a good sound-insulating effect, it is advantageous that the sound-insulating device is not placed in direct contact with the inside of the tank. Insulating fluid should occur between the sound-insulating device and the inside of the tank. Experiments have shown that it is advantageous to place the sound-damping device closer to the active part than the inside of the tank, and according to a preferred embodiment of the induction machine, the sound-insulating device is placed such that the shortest distance between the device and the active part is smaller than the shortest distance between the sound-insulating device and the inside of the tank. Preferably, the sound-insulating device is placed as close to the active part as possible, whereby the liquid volume between the sound-damping plate and the inside of the tank is as large as possible.

BRIEF DESCRIPTION OF THE DRAWINGS

The invention will be explained in greater detail in the following with reference to the accompanying drawings, wherein.

DESCRIPTION OF THE PREFERRED EMBODIMENT

Figure 1:
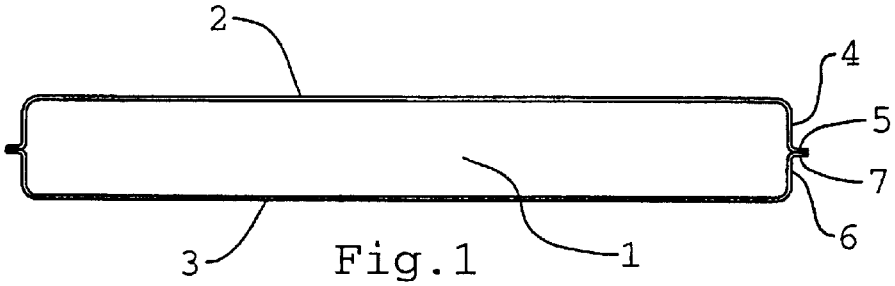
FIG. 1 shows a first embodiment of the sound-insulating device according to the invention.

FIG. 1 shows a first embodiment of the sound-insulating device, in the form of a circular sound-insulating plate. FIG. 1 shows the plate in a section along the diameter of the plate. The plate comprises a gas-filled cavity 1 and a resilient membrane surrounding the cavity and consisting of a first membrane portion 2, at the top in the figure, and a second membrane portion 3, at the bottom in the figure. The membrane portion 2 has a part 4 which is folded along its circumference, in FIG. 2 folded down, which part 4 terminates in a plane edge 5. In the same way, the membrane portion 3 has a part 6 which is folded along its circumference, in FIG. 2 folded up, which part 6 also terminates in a plane edge 7. At their edges 5 and 7, the membrane portions are gas-tightly attached to each other. A valve (not shown) may be arranged in any of the membrane portions, through which valve gas is pumped into or out of the cavity 1, during manufacture of the plate, such that the desired pressure is obtained in the cavity, whereupon the valve is hermetically sealed, for example by being welded. The gas is preferably air, but also other gases may be used.

The membrane portions 2 and 3 are preferably manufactured from thin, stainless sheet metal of uniform thickness, into which the folded parts 4 and 6 as well as the edges 5 and 7 are pressed. The plate shall operate in an induction machine for a long period of time. Since gas from a leaking plate may destroy the induction machine in which the plate is mounted, stainless sheet metal is a suitable material from the point of view of corrosion, especially considering the fact that the service life of an induction machine may be very long. Experiments have shown that a suitable wall thickness of the membrane is in the interval of 0.1–4 mm. A suitable diameter of the plate is in the interval of 250–550 mm and a suitable thickness of the plate. is in the interval of 30–60 mm. By its construction with two membrane halves of thin, stainless sheet metal of uniform thickness, which are pressed and gas-tightly attached to each other, a sound-damping device is obtained which is simple and inexpensive to manufacture.

Figure 3:
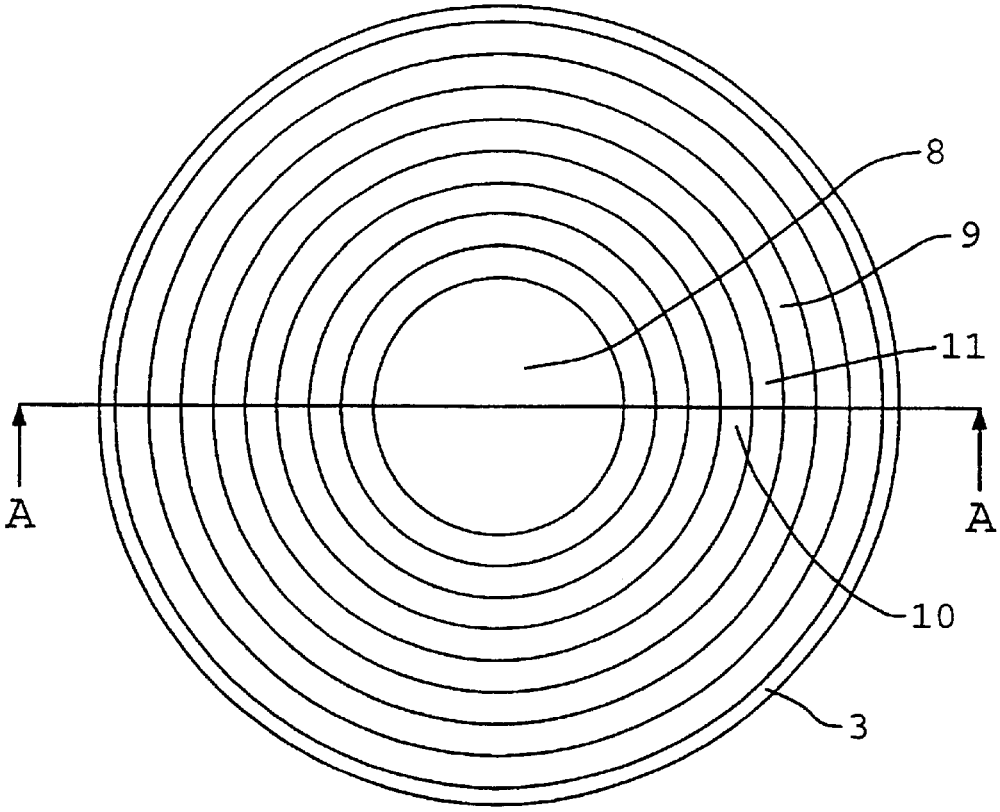
FIGS. 2 and 3 shows a second embodiment of the sound-insulating device according to the invention.
Figure 2:
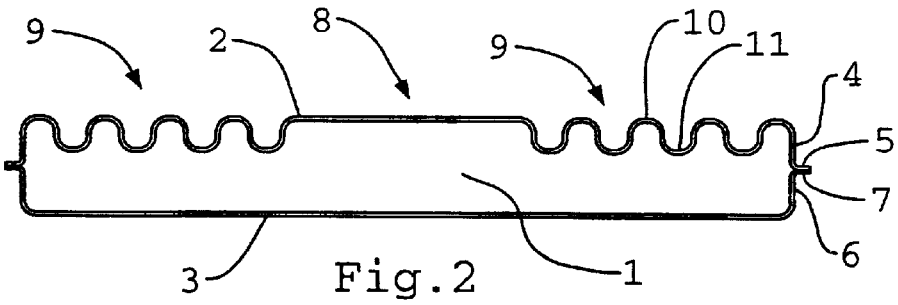

FIGS. 2 and 3 show a plate with a membrane formed such that it is able to withstand the pressure of the insulating fluid but which, at the same time, is very resilient. FIG. 3 shows the plate from above, and FIG. 2 shows the plate in a section along the diameter of the plate, that is, along the line marked A—A in FIG. 3. In this embodiment, the first membrane portion 2 has a plane region in the centre of the portion, and a folded or corrugated region 9. with ridges 10 and valleys 11 concentrically arranged around the centre of the membrane portion 2, the region 9 surrounding the plane region 8. Because of the folded region, the plane is extremely compressible in a direction-orthogonally to the plane of the plate. In FIGS. 2 and 3, the folded region 9 covers approximately half of the membrane portion 2. However, embodiments are possible wherein the folded region covers a larger or smaller part of the membrane portion than that which is shown in FIGS. 2 and 3. In one embodiment, for example, the folded region may cover substantially the entire membrane.

Figure 4:
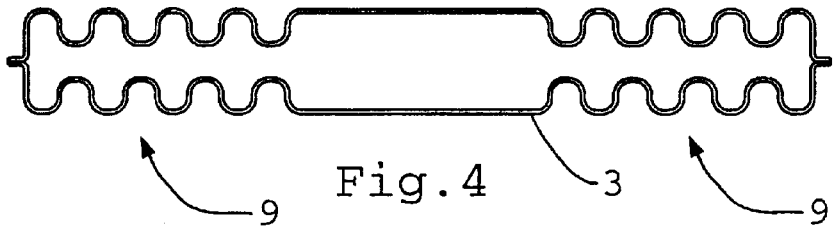
FIG. 4 shows a third embodiment of the sound-insulating device according to the invention.

A third embodiment of the sound-insulating device is shown in FIG. 4 in the form of a sound-insulating plate where also the second membrane portion 3 of the plate, the bottom one in the figure, is provided with a folded region 9. This arrangement further increases the compressibility of the plate.

As previously mentioned, it is advantageous if the pressure in the cavity is low. Preferably, the cavity shall be almost evacuated of gas. For the embodiments described with reference to FIGS. 1–4, a certain gas pressure must be allowed in the cavity to prevent the membrane portions 2 and 3 from being brought into rigid contact with each other. In addition to the fact that too high a pressure suppresses the compressibility of the plate and hence the sound-insulating ability thereof, this arrangement entails a risk of gas leaking out into the insulating fluid of the induction machine. This may drastically deteriorate the insulating properties of the insulating fluid and lead to the occurrence of electrical flashovers which are devastating to the induction machine.

Figure 5:
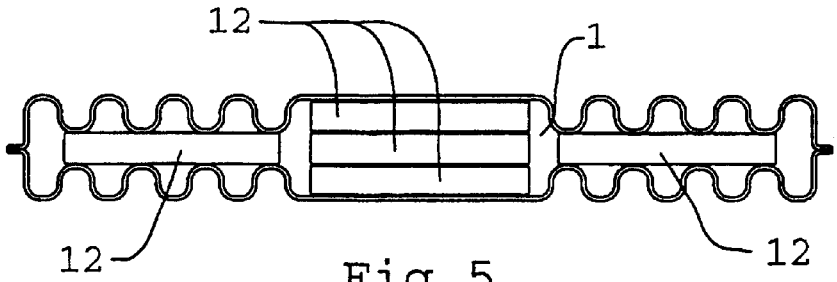
FIG. 5 shows a fourth embodiment of the sound-insulating device according to the invention.
Figure 6:
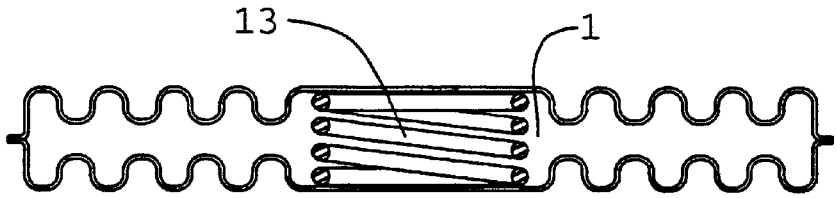
FIG. 6 shows a fifth embodiment of the sound-insulating device according to the invention.
Figure 7:
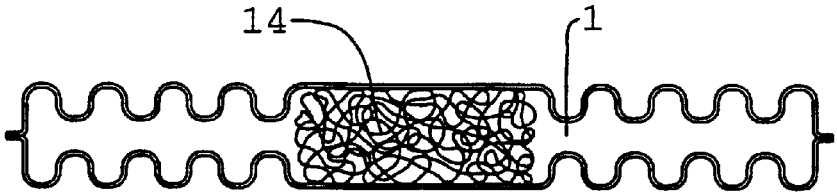
FIG. 7 shows a sixth embodiment of the sound-insulating device according to the invention.

By arranging one or a plurality of resilient spacing members in the cavity, which at at least two points make contact with the membrane, a very low gas pressure may be allowed in the cavity since the spacing member prevents the membrane portions 2 and 3 from being brought into contact with each other. By forming the spacing members resilient, the desired compressibility of the device may be obtained in a simple manner while at the same time the membrane may be designed resilient. FIG. 5 shows an embodiment of the sound-insulating device in the form of a sound-insulating plate, where a resilient spacing member in the form of five resilient rubber plates 12 are placed in the cavity 1. FIG. 6 shows another embodiment in which a spacing member in the form of a spiral spring 13 is placed in the cavity 1, and FIG. 7 shows a further embodiment in which a spacing member in the form of a resilient steel-wool cushion 14 is placed in the cavity 1. By choosing spacing members and their dimensions, sound-insulating plates with different compressibility may be easily obtained.

Figure 8:
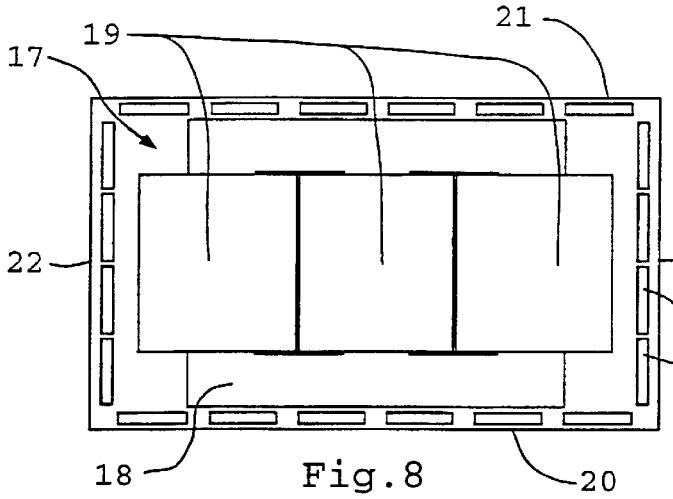
FIGS. 8–10 show in three orthogonal views a first embodiment of a transformer according to the invention.
Figure 9:
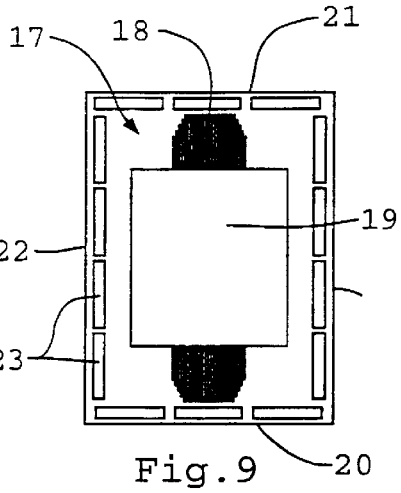
Figure 10:
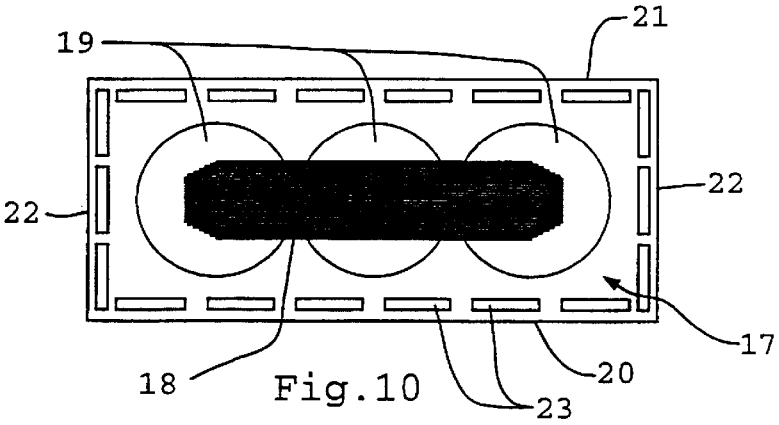

To prevent oscillations in the insulating fluid from reaching the tank, the sound-insulating device shall be mounted between the active part and the tank. Preferably, the sound-insulating device has an extent in one plane and preferably the sound-insulating device is arranged at right angles to the direction of propagation of the oscillations. FIGS. 8–10 show in three orthogonal views a transformer according to the invention, in which a plurality of sound-insulating plates of the type previously described with reference to FIGS. 1–7, are mounted. The transformer comprises a tank filled with insulating fluid, in which tank an active part 17 with an iron core 18 and a winding subassembly 19 is placed. The inside of the tank has a floor portion 20, a roof portion 21 and a wall portion 22. A number of features such as bushings, connection leads to the winding subassemblies and other equipment normally occurring in a transformer are excluded from the figures for the sake of clarity. In the vicinity of the inside of the tank, but not in contact therewith, a plurality of sound-insulating plates 23 are mounted on stands (not shown). Each plate is aligned in such a way that one side of the plate substantially faces the active part,.and the other side of the plate substantially faces the inside of the tank, that is, the floor portion 20, the roof portion 21 or the wall portion 22.

Figure 11:
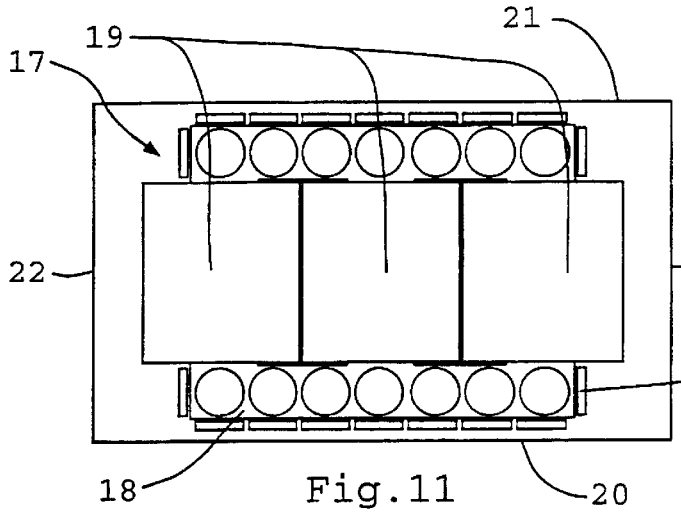
FIGS. 11–13 show in three orthogonal views a second embodiment of a transformer according to the invention.
Figure 12:
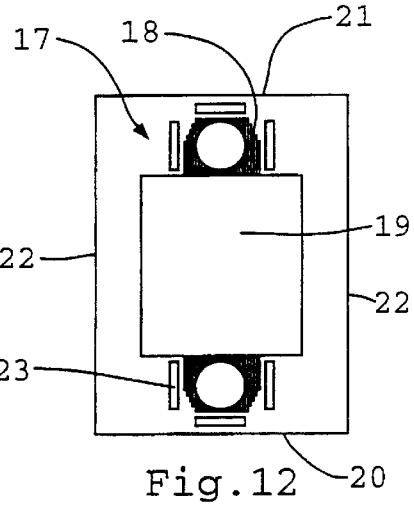
Figure 13:
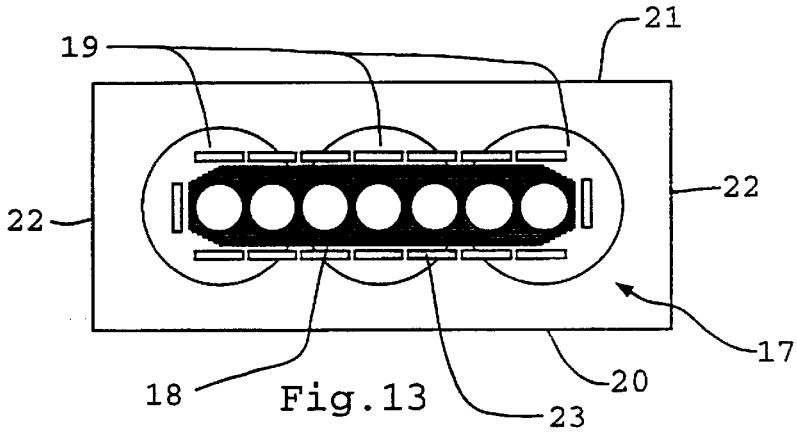

FIGS. 11–13 show in three orthogonal views a preferred location of the sound-damping plates which, during experiments, have proved to provide a great sound-insulating effect. In this embodiment, the plates 23 are placed closer to the active part than the inside of the tank 17 such that the shortest distance between each plate and the active part is smaller than the shortest distance between the plate and the inside of the tank 17. In this arrangement, it is advantageous for each plate to be aligned in parallel with that of the surfaces of the core 18 which is closest to the plate.

The plates 23 are preferably placed as close to the core 18 as possible.

The embodiments described above are to be regarded as examples since other, embodiments may be achieved within the scope of the invention. The sound-insulating device may, for example, assume other shapes than that of the circular plate described above, and the corrugated region may assume other shapes than that shown above having concentrically arranged ridges and valleys, for example a region which is corrugated in two directions so as to obtain a waffle pattern.

What is claimed is:

1. A stationary sound-insulating device for reducing sound radiation from an induction machine with an active part, an insulating fluid surrounding the active part, and a tank enclosing the insulating fluid, wherein the sound-insulating device comprises a gas-filled cavity, wherein the sound-insulating device further comprises a resilient membrane surrounding the gas-filled cavity.

2. A sound-insulating device according to claim 1, wherein the device is extended in one plane and the membrane has a first membrane portion extending in the direction of the plane and a second membrane portion arranged substantially in parallel with the first membrane portion.

3. A sound-insulating device according to claim 2, wherein any of the membrane portions has at least one corrugated region.

4. A sound-insulating device according to claim 3, wherein the corrugated region covers at least one half of the membrane portion.

5. A sound-insulating device according to claim 4, wherein the corrugated region covers substantially the entire membrane portion.

6. A sound-insulating device according to claim 1, wherein the pressure in the cavity exceeds or is equal to the absolute pressure of the insulating fluid.

7. A sound-insulating device according to claim 1, wherein the pressure in the cavity is lower than the absolute pressure of the insulating fluid.

8. A sound-insulating device according to claim 1, wherein a resilient spacing member is arranged in the cavity making contact with the membrane at at least two points.

9. A sound-insulating device according claim 8, wherein the spacing member comprises a rubber plate.

10. A sound-insulating device according claim 8, wherein the spacing member comprises a spiral spring.

11. A sound-insulating device according claim 8, wherein the spacing member comprises a cushion of steel-wool.

12. A sound-insulating device according to claim 1, wherein the membrane has a substantially constant thickness.

13. A sound-insulating device according to claim 1, wherein the membrane is of thin, stainless sheet steel.

14. A stationary induction machine with an active part comprising a core and a winding subassembly, an insulating fluid surrounding the active part, a tank enclosing the insulating fluid, and at last one sound-insulating device arranged in the insulating fluid between the active part and the tank, said device comprising a gas-filled cavity, wherein the sound-insulating device further comprises a resilient membrane surrounding the cavity, the sound-insulating device being arranged spaced from the inside of the tank.

15. An induction machine according claim 14, wherein the sound-insulating device is extended in one plane and is aligned substantially parallel to the inside of the tank, whereby the membrane has a first membrane portion extending in the direction of the plane and facing the active part, and a second membrane portion arranged substantially parallel to the first membrane portion and facing the inside of the tank.

16. Use of an induction machine according to claim 15 in a distribution or transmission network.

17. An induction machine according to claim 15, wherein any of the membrane portions has at least one corrugated region.

18. An induction machine according to claim 14, wherein a resilient spacing member is arranged in the cavity making contact with the membrane portion at at least two points.

19. An induction machine according to claim 14, wherein the membrane has a substantially constant thickness.

20. An induction machine according claim 14, wherein the sound-insulating device is extended in one plane and is aligned substantially parallel to that of the surfaces of the core which is closest to the plate, whereby the membrane has a first membrane portion extending in the direction of the plane and facing the core and a second membrane portion arranged substantially parallel to the first membrane portion and facing the inside of the tank.

* * * * *